US006680720B1

(12) United States Patent
Lee et al.

(10) Patent No.: US 6,680,720 B1
(45) Date of Patent: Jan. 20, 2004

(54) APPARATUS FOR DRIVING LIQUID CRYSTAL DISPLAY

(75) Inventors: Hyun Chang Lee, Kumi-shi (KR); Keuk Sang Kwon, Kumi-shi (KR)

(73) Assignee: LG. Phillips LCD Co., Ltd., Seoul (KR)

( * ) Notice: Subject to any disclaimer, the term of this patent is extended or adjusted under 35 U.S.C. 154(b) by 0 days.

(21) Appl. No.: 09/470,095

(22) Filed: Dec. 21, 1999

(30) Foreign Application Priority Data

Jan. 11, 1999 (KR) ..... P1999-376

(51) Int. Cl.[7] ..... G09G 3/36
(52) U.S. Cl. ..... 345/90; 345/100
(58) Field of Search ..... 345/90, 98, 99, 345/100, 87, 88, 92, 93, 204, 213, 214

(56) References Cited

U.S. PATENT DOCUMENTS 5,148,301 A * 9/1992 Sawatsubashi et al. ..... 359/153
5,448,259 A * 9/1995 Hidaka ..... 345/99
5,719,648 A * 2/1998 Yoshii et al. ..... 349/42
5,777,515 A * 7/1998 Kimura ..... 330/257
5,801,400 A * 9/1998 Nishihata ..... 257/72
5,864,327 A * 1/1999 Kokuhata et al. ..... 345/90
5,903,246 A * 5/1999 Dingwall ..... 345/82
6,052,103 A * 4/2000 Fujiwara et al. ..... 345/89
6,115,018 A * 9/2000 Okumura et al. ..... 345/95
6,118,425 A * 9/2000 Kudo et al. ..... 345/100
6,219,020 B1 * 4/2001 Furuhashi et al. ..... 345/100
6,249,269 B1 * 6/2001 Blalock et al. ..... 345/97
6,271,817 B1 * 8/2001 Wakai et al. ..... 345/91
6,331,844 B1 * 12/2001 Okumura et al. ..... 345/87

FOREIGN PATENT DOCUMENTS

JP 7-114045 5/1995
JP 7-244296 9/1995
JP 8-43793 2/1996

* cited by examiner

*Primary Examiner*—Bipin Shalwala
*Assistant Examiner*—Mansour M. Said
(74) *Attorney, Agent, or Firm*—Birch, Stewart, Kolasch & Birch, LLP

(57) ABSTRACT

A liquid crystal panel driving apparatus is adapted to display a uniform level of luminance on an entire display area of a liquid crystal panel. The liquid crystal panel drive apparatus applies an alternative current signal to a storage line on the liquid crystal panel so that the signal voltage charged at each picture element on the first gate line is substantially equal to the signal voltage charged at each picture element on the second to last gate lines. As a result, the luminance level on a first line of the liquid crystal panel is substantially equal to that on the remaining lines and the luminance level is uniformly displayed on the liquid crystal panel, and further enhances the quality of a picture displayed on the liquid crystal panel.

17 Claims, 10 Drawing Sheets

APPARATUS FOR DRIVING LIQUID CRYSTAL DISPLAY

BACKGROUND OF THE INVENTION

1. Field of the Invention

This invention relates to a liquid crystal display device, and more particularly, to an apparatus for driving a liquid crystal panel to display a uniform luminance in an entire display area of the liquid crystal panel.

2. Description of the Related Art

Conventionally, a liquid crystal display device (hereinafter LCD) includes a liquid crystal panel and a drive circuit for driving the liquid crystal panel. The liquid crystal panel includes a plurality of liquid crystal cells arranged between two glass-like substrates (e.g., an upper glass substrate and a lower glass substrate), and switching elements (e.g., a thin film transistor (hereinafter TFT) array). The drive circuit is typically provided with gate driving integrated circuits (hereinafter "gate D-IC") and data driving integrated circuits (hereinafter "data D-IC").

In a liquid crystal panel, included circuitry uses a system of storage on gate, as shown in FIG. 1. The circuitry of FIG. 1 includes picture elements (or pixels) that are arranged at intersections of gate lines GL1 to GLn and data lines DL1 to DLm, respectively. Each of the picture elements includes a TFT (MN11 to MNnm) having a gate terminal connected with the gate line GL, a source terminal connected with the: data line DL, a liquid crystal cell (CLC11 to CLCnm) connected between the drain terminal of the TFT and a common voltage line VCL, and an additional capacitor (Cst11 to Cstnm) connected to the drain terminal of the TFT. The additional capacitors Cst21 to Cstnm arranged on the second to nth gate lines GL2 to GLn are also connected to the corresponding previous gate lines GL1 to GLn−1, respectively, whereas the additional capacitors Cst11 to Cst1*m* on the first gate line GL1 are connected to a storage line SL. Each data line DL1 to DLm receives a video signal from a data D-IC, and each gate line GL1 to GLn inputs a gate signal (GS1 to GSn) from a gate D-IC.

Data lines DL1 to DLm are driven using the dot inversion system. In the dot inversion system, a video signal on one data line DLi has a polarity that is opposite to that of the video signals on data lines DLi−1 and DLi+1, both of which are adjacent to data line DLi. The TFTs MN are selectively turned-on by the gate signal having a pulse shape in order to transmit the video signals on the data lines DL1 to DLm to the liquid crystal cells CLC and the additional capacitors Cst. Then, the liquid crystal cells CLC and the additional capacitors Cst charge the video signal applied from the data line DL through the TFT MN, and maintain the charged signal voltage until the TFTs are turned-on again (i.e., during turning-off of the TFTs). Storage line SL is used as a storage capacitor of the picture elements connected to first gate line GL1. Similarly, the first to (n−1)th gate lines GL1 to GLN−1 are used as the storage capacitor of the picture elements on the second to nth gate lines GL2 to GLn, respectively.

Referring to FIG. 2, a storage signal SS applied to the storage line SL has a direct current voltage maintaining a constant voltage level (e.g., −5V). It is possible to set the voltage level of the storage signal SS equal to the low voltage level of the gate signal GS. Also, gate lines GL1 to GLn receive pulse-shaped gate signals GS1 to GSn, which have trailing edges that gradually descend. This is caused by the gate signal GS being delayed by an output buffer (snot shown) and wiring included in the gare D-IC if a high voltage and a low voltage of the gate signal GS are 20V and −5V. respectively, the trailing edge of the gate signal GS consumes about a few milliseconds. More specifically, the trailing esge of the gate signal falls from the voltage level of 20V to the voltage level of −4.96V within several microseconds, and then from the voltage level of −4.96V to the voltage level of −5V in period of a few milliseconds. Because the storage signal SS on the storage line SL maintains a constant voltage level, and because each gate signal GS1 to GSn does not maintain a constant voltage level, esch pixel voltage charged at each picture element on the first gate line GL1 is different from each pixel voltage charged at each picture element on the rest of the gate lines GL2 to GLn.

Such a pixel voltage difference between the gate lines GL1 to GLn will be described in reference to FIGS. 3A and 3B. FIG. 3A shows a waveform of pixel voltage VS1 charged at the picture element on the first gate line GL1, and FIG. 3B represents a waveform of pixel voltage VS2 charged at each picture element on the rest of the gate lines (i.e., the second to last gate lines GL2 to GLn). Referring to FIGS. 3A and 3B, a predetermined level of voltage difference is generated between the pixel voltage VS1 charged at the picture element on first gate line GS1 and the pixel voltage VS2 charged at each pixel on the rest of the gate lines GL2 to GLn, although the data signals having the same voltage are applied to all of the lines. For example, if the data signal to be applied to each picture element on the first gate line GL1 and the rest of the gate lines GL2 to GLn is 5V when the common voltage is fixed at 3V, +2V is the charge at each picture element on the first gate line GL1 and each picture element on the rest of the gate lines GL2 to GLn at first. However, the storage voltage at the picture element on the first gate line GL1 maintains the voltage level of −5V after the TFT on the first gate line GL1 is turned off, while the storage voltage at each picture element on the rest of the gate lines GL2 to GLn has the voltage level of −4.96V at the moment when the TFTs on the rest of the gate lines GL2 to GLn are turned off. The storage voltage at each picture element on the rest of the gate lines GL2 to GLn decreases gradually and drops down to −5V after several milliseconds from the moment when the TFTs on the rest of the gate lines GL2 to GLn are turned off. Since the storage voltage drops down when the TFTs are turned off, the voltage VS2 charged at each picture element on the rest of the gate lines GL2 to GLn also drops by a capacitor coupling effect. If this voltage drop is represented by ΔV, there exists a voltage difference of ΔV between the picture elements on the first and second gate lines GL2 and GL2. The voltage difference ΔV in the above example can be calculated as shown in equation 1 below.

$$\Delta V=[C_{st}\cdot(-4.96-(-5.0))]/(C_{LC}+C_{st}+C_{gs}) \quad (1)$$

In the above equation, "$C_{LC}$" and "$C_{st}$" are the capacitance of the liquid crystal cell $C_{LC}$ and the capacitance of the storage capacitors $C_{st}$, respectively, and "$C_{gs}$" represents a parasitic capacitance between the gate and source terminals of TFT MN. The different voltage ΔV is below 40 mV in the above case. Due to the different voltage ΔV between the first pixel voltage(VS1) on each picture element of the first gate line GL1 and the second pixel voltage(VS2) on each picture element of the second to nth gate lines, the luminance level on a first line of the liquid crystal panel is different from that of the rest of the lines of the liquid crystal panel.

SUMMARY OF THE INVENTION

To overcome the problems described above, preferred embodiments of the present invention provide a liquid crystal panel drive apparatus that displays a uniform luminance level on the entire liquid crystal panel.

A liquid crystal panel drive apparatus according to one preferred embodiment of the present invention applies an alternative current signal to a storage line on the liquid crystal panel.

A liquid crystal panel drive apparatus according to another preferred embodiment of the present invention includes a connector connecting a storage line on a liquid crystal panel with a gate line among a plurality of the gate lines on the liquid crystal panel.

A liquid crystal panel drive apparatus according to still another preferred embodiment of the present invention includes a gate driver for driving a plurality of gate lines on the liquid crystal panel and a storage drive terminal provided near the gate driver, the storage drive terminal driving a storage line on the liquid crystal panel.

These and other aspects, features, elements and advantages of the present invention will be apparent from the following detailed description of preferred embodiments of the present invention with reference to the accompanying drawings.

BRIEF DESCRIPTION OF THE DRAWINGS

The present invention will be more fully understood from the detailed description provided below and the accompanying drawings which are only illustrative and not limiting of the present, with like reference numerals indicating like elements and wherein.

DETAILED DESCRIPTION OF PREFERRED EMBODIMENTS

Preferred embodiments of the present invention for securing a uniform luminance level on a liquid crystal panel will be described in detail with references to FIGS. 4 to 10 below.

Figure 1:
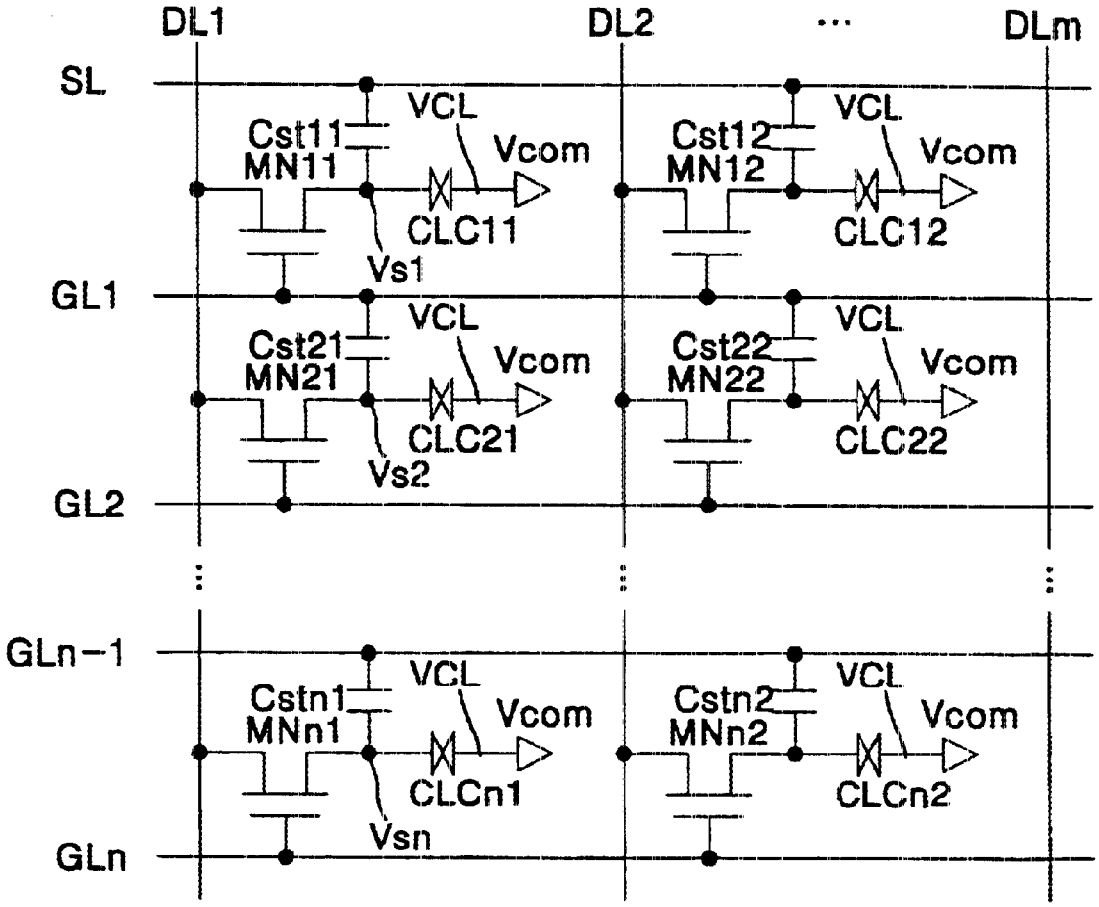
FIG.1 PRIOR ART
FIG. 1 is a circuit diagram of a conventional liquid crystal panel implemented using a system of storage on gate.
Figure 2:
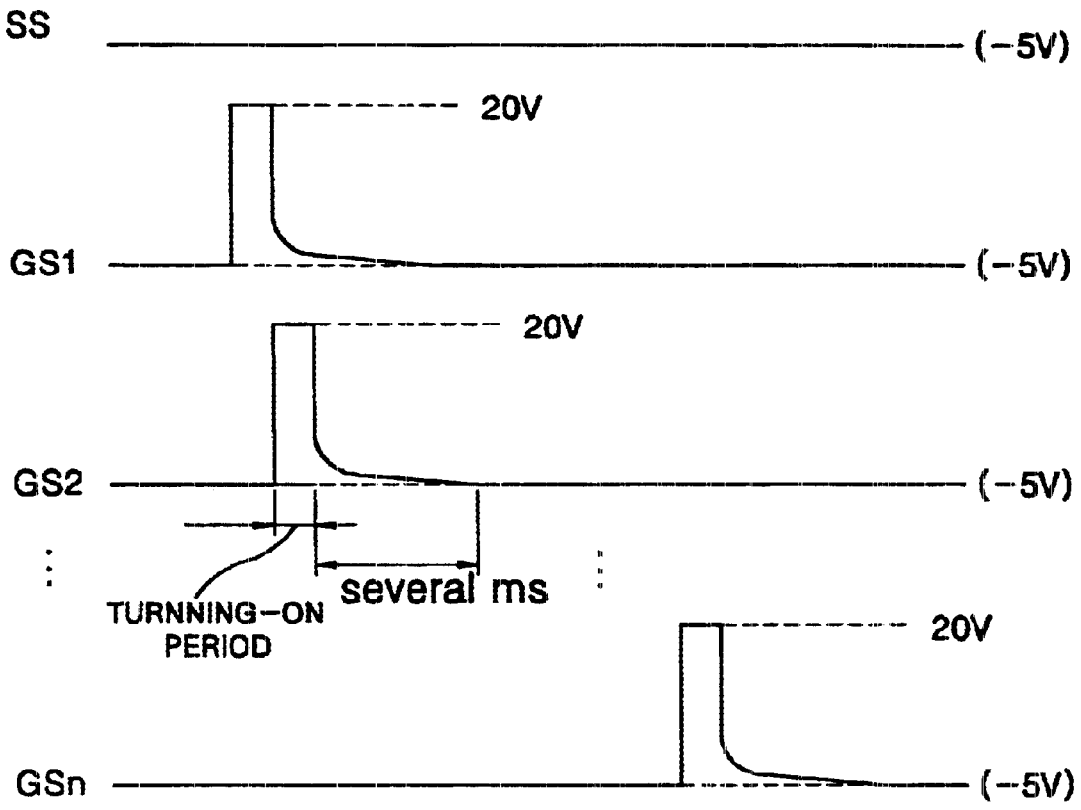
FIG.2 PRIOR ART
FIG. 2 is a waveform diagram showing signals applied to the storage line and gate lines in FIG. 1.
Figure 3A:
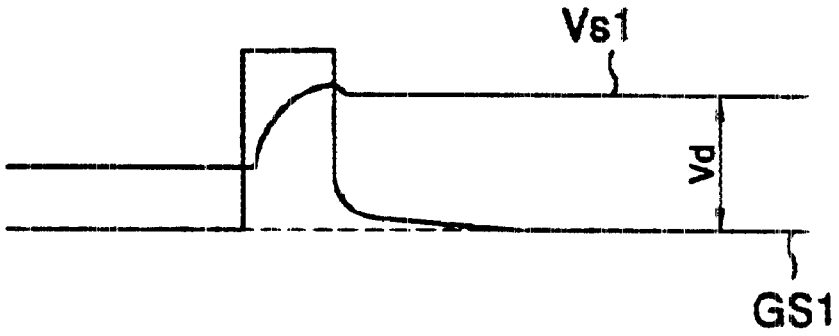
FIG.3A PRIOR ART
FIGS. 3A and 3B are waveform diagrams showing voltage signals charged respectively in picture elements in FIG. 1.
Figure 3B:
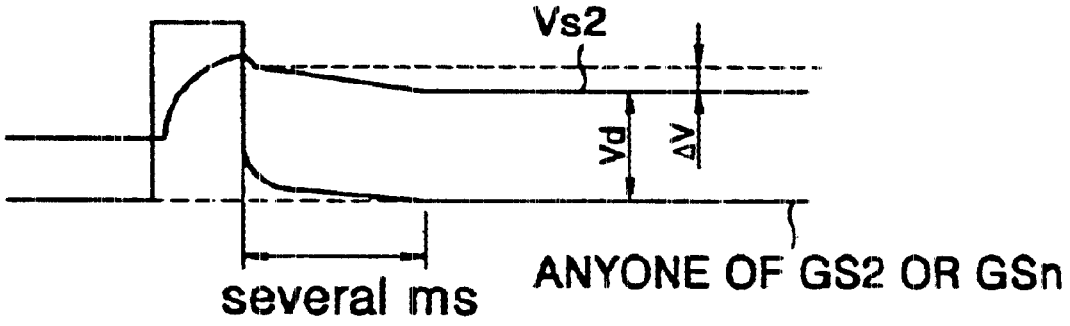
FIG.3B PRIOR ART
Figure 4:
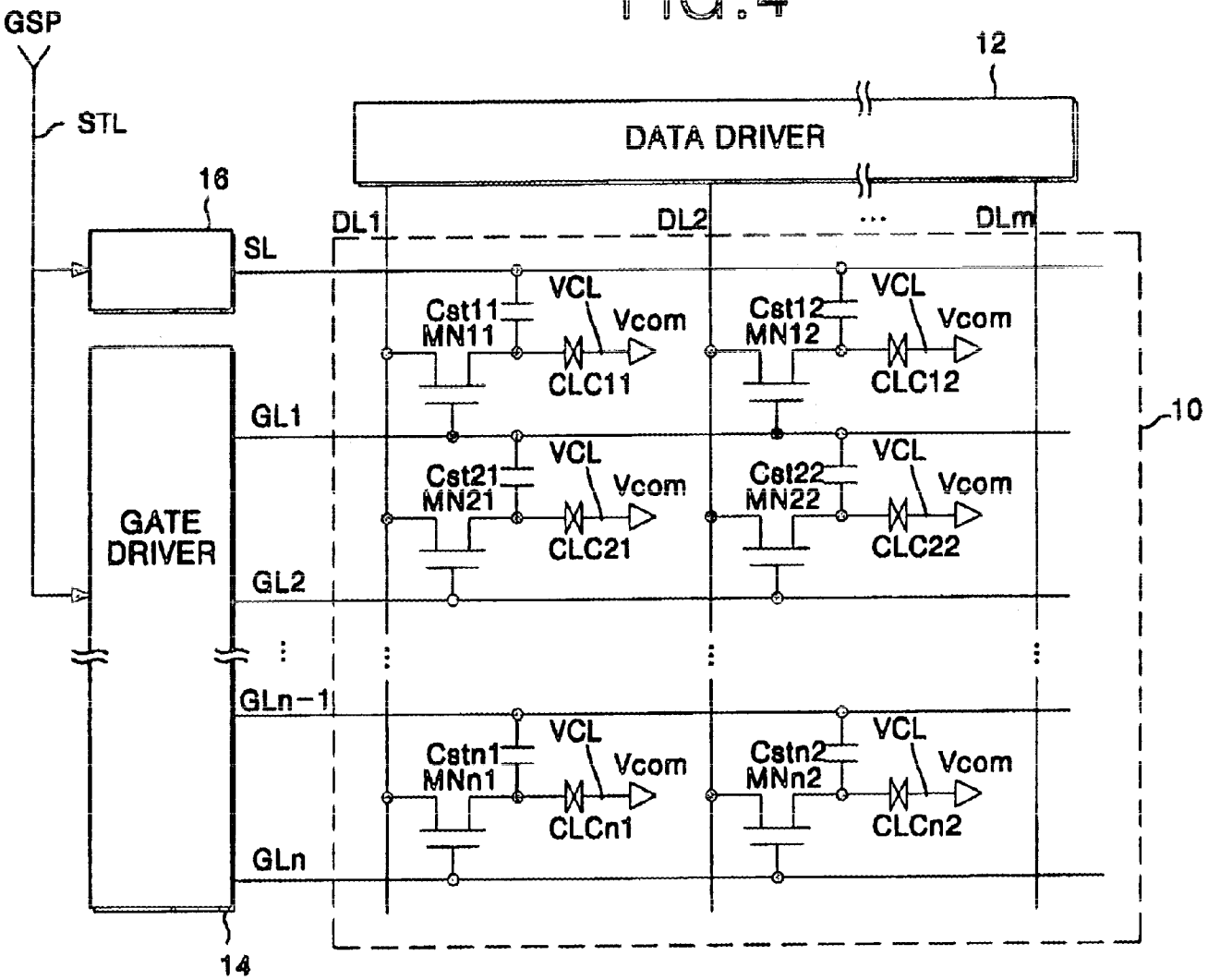
FIG. 4 is a schematic view showing a liquid crystal panel drive apparatus according to a preferred embodiment of the present invention.

FIG. 4 illustrates a liquid crystal panel drive apparatus according to a preferred embodiment of the present invention. The liquid crystal panel drive apparatus of FIG. 4 preferably includes a liquid crystal panel 10 having picture elements (or pixels) arranged at intersections of gate lines GL1 to GLn and data lines DL1 to DLm, respectively. Each picture element includes a TFT (MN11 to MNnm) having a gate terminal connected with gate line GL and a source terminal connected with the data line DL, a liquid crystal cell (CLC11 to CLCnm) connected between the drain terminal of the TFT and a common voltage line VCL, and an additional capacitor (Cst11 to Cstnm) connected to the drain terminal of the TFT. The additional capacitors Cst21 to Cstnm arranged on the second to nth gate lines GL2 to GLn are also connected to the respective gate line GL1 to GLn−1, respectively. Whereas, the additional capacitors Cst11 to Cst1*m* on first gate line GL1 are connected to a storage line SL. The storage line SL is used as a storage capacitor of picture elements connected to the first gate line GL1. Similarly, gate lines GL1 to GLn−1 are used as a storage capacitors for picture elements on gate lines GL2 to GLn.

The liquid crystal panel drive apparatus also preferably includes a data driver 12 connected to data lines DL1 to DLm on the liquid crystal panel 10. The data driver 12 preferably applies video signals to data lines DL1 to DLm on the liquid crystal panel 10 during every horizontal synchronous period. The data driver 12 can also drive the data lines DL1 to DLm on the liquid crystal panel 10 using a dot inversion system. In the dot inversion system, the video signal on one data line DLi preferably has a polarity that is opposite to that of the video signals on the data lines DLi−1 and DLi+1, both of which are adjacent to data line DLi.

Figure 5:
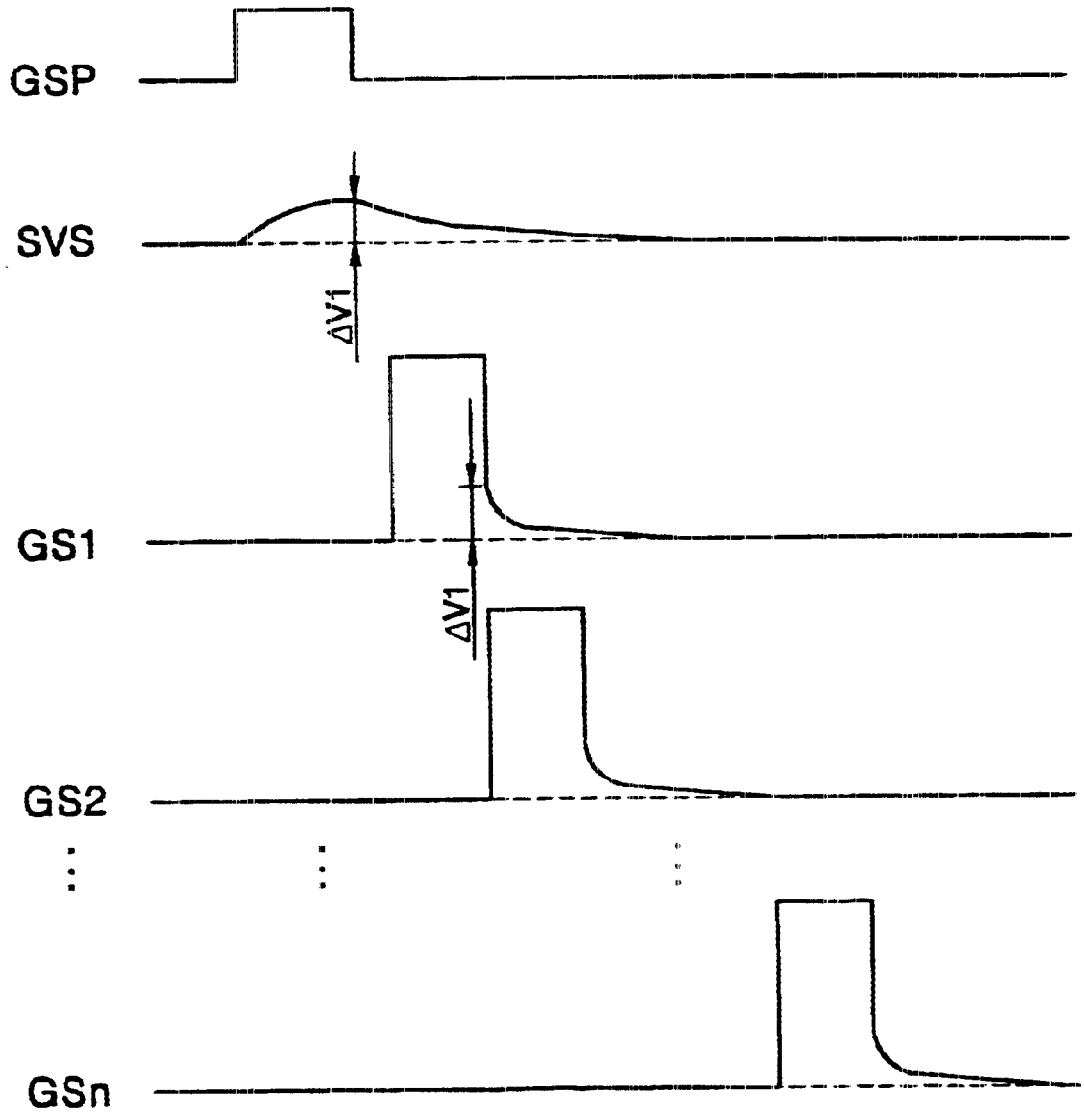
FIG. 5 is a waveform diagram showing signals applied to the storage line and gate lines in FIG. 4.

The liquid crystal panel drive apparatus preferably has a gate driver 14 and a storage line driver 16 that respond to a gate start signal GSP received from a start signal line STL. The gate driver 14 generates n gate signals GS1 to GSn when the gate start signal is at a high logic pulse level. The n gate signals GS1 to GSn have sequential high logic pulses that are aligned adjacently with each other, as shown in FIG. 5. The trailing edge of each gate signal GS consumes about a few milliseconds. More specifically, the trailing edge of the gate signal decreases from the voltage level of 20V to the voltage level of −4.96V within several microseconds, and from the voltage level of −4.96V to the voltage level of −5V in period of a few milliseconds. The gate driver 14 applies n gate signals GS1 to GSn to n gate lines GL1 to GLn, respectively.

The storage line driver 16 generates a storage voltage signal SVS every time the gate start signal GSP of the high logic pulse level is applied. The storage voltage signal SVS increases from the voltage level of −5V at the rising edge of the gate start signal GSP until the trailing edge of the gate start signal GSP, and decreases gradually to the voltage level of −5 at the trailing edge of the gate start signal GSP, as shown in FIG. 5. As a result, the storage voltage signal maintains the voltage level of −4.96V during several microseconds beginning at the trailing edge of the first gate signal GS1. Such a storage voltage signal SVS is applied to the storage line SL on the liquid crystal panel 10.

TFTs MN are preferably sequentially turned-on by the gate signals GS1 to GSn for one line. The video signals on data lines DL1 to DLm are simultaneously applied to the liquid crystal cells CLC and to the additional capacitors Cst through each TFT MN. Then, liquid crystal cells CLC and the additional capacitors Cst charge the video signal applied from the data line DL through the TFT MN and maintain the charged signal voltage until the TFT is turned-on again (i.e., during turning-off of the TFT).

Figure 6A:
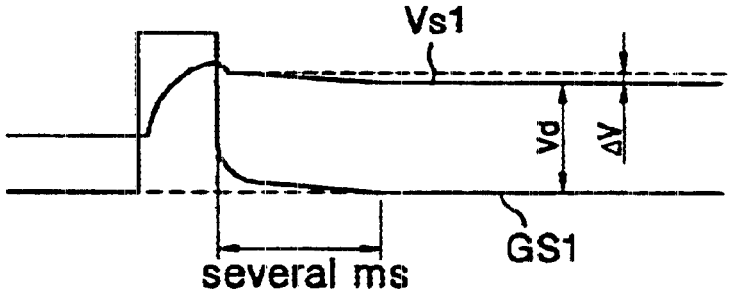
FIGS. 6A and 6B are waveform diagrams showing voltage signals charged respectively in picture elements in FIG. 4.
Figure 6B:
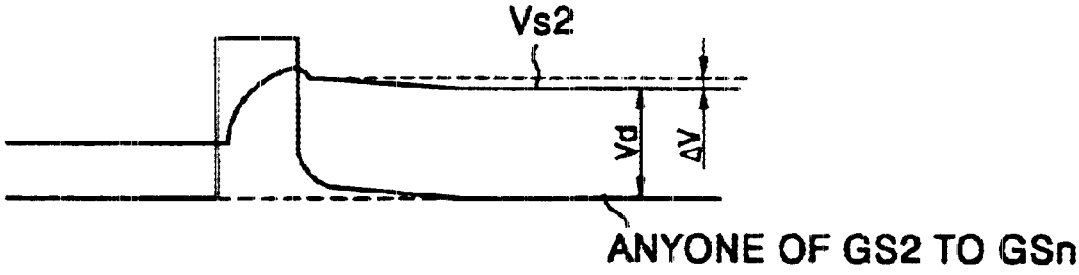

When the TFTs MN11 to MN1*m* on the first gate line GL1 are turned-off, the storage voltage signal on the storage line SL maintains the voltage level of −4.96V. Each gate signal GS1 to GSn−1 on the first to (n−1)th gate lines GL1 to GLn−1 has the voltage level of −4.96V when the TFTs MN21 to MNnm on each gate line GL2 to GLn are turned-off. As a result, the picture elements on the liquid crystal panel 10 charge the same signal voltage when the same video signal is applied to the picture elements on the liquid crystal panel. In particular, the picture elements on the first gate line GL1 each charges a signal voltage VS1 higher than the low level voltage of the gate signal GS to Vd, as shown in FIG. 6A. Similarly, the picture elements on the second to nth gate lines each charge a second signal voltage VS2 higher than the low voltage level of the gate signal GS by Vd (as shown in FIG. 6B).

As described above, the signal voltage Vd charged at each picture element on the first gate line GL1 is equal to the signal voltage Vd charged at each picture element on the second to nth gate lines GL2 to GLn. As a result, the luminance level on a first line of the liquid crystal panel is substantially equal to that on the remaining lines of the liquid crystal display apparatus and a uniform luminance is displayed on the liquid crystal panel 10. Furthermore, the quality of a picture displayed on the liquid crystal panel 10 is greatly improved.

Figure 7:
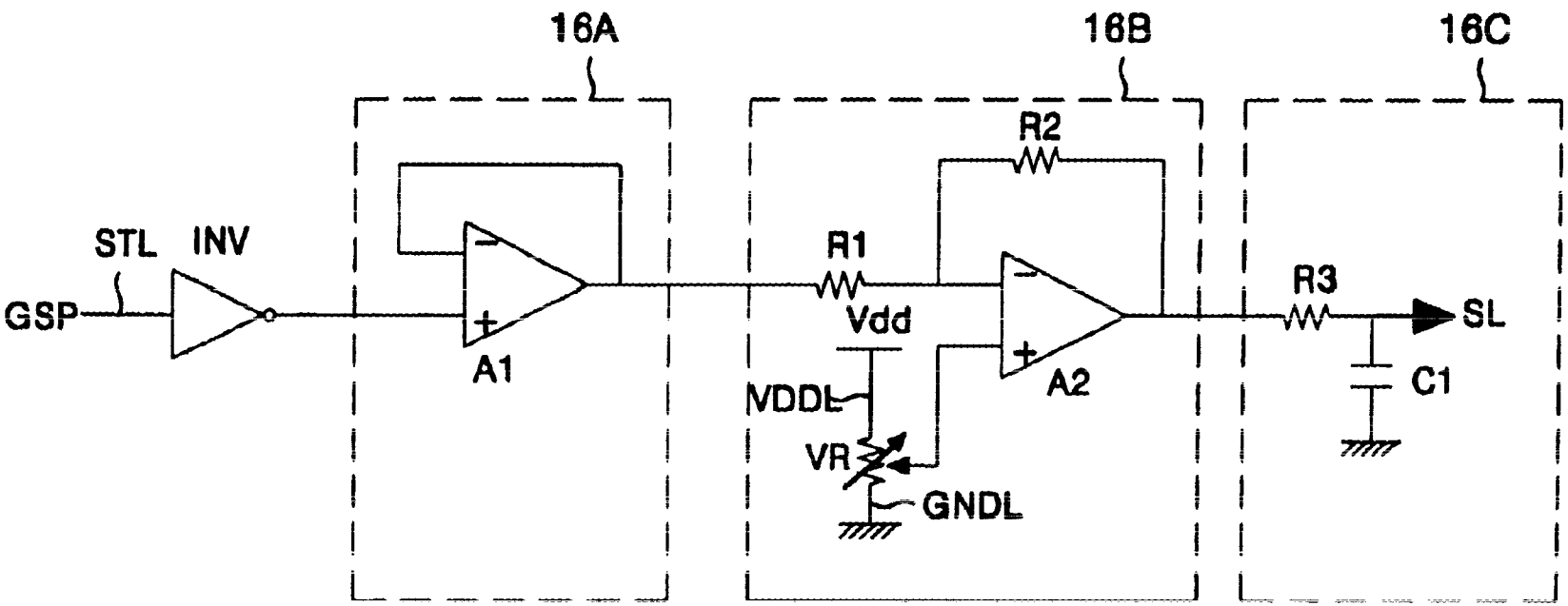
FIG. 7 shows a preferred embodiment of the storage line driver in FIG. 4.

FIG. 7 shows in detail a preferred embodiment of the storage line driver 16 in FIG. 4. In FIG. 7, the storage line driver 16 preferably includes an inverter INV, a first amplifying stage 16A, a second amplifying stage 16B, and an integrator 16C connected between the start signal line STL and the storage line SL. The inverter INV inverts the gate start signal from the start signal line STL. An inverted gate start signal/GSP generated in the output terminal of the inverter INV is applied to the first amplifying stage 16A, which performs a current amplification for the inverted gate start signal/GSP. To this end, the first amplifying stage 16A includes a first operational amplifier A1 having an inverting terminal (−) connected to its output terminal and a non-inverting terminal (+) connected to the inverter INV. The first operational amplifier A1 amplifies the current amount of the inverted gate start signal/GSP that is received from the inverter INV to the non-inverting terminal (+). As a result, the inverted gate start signal that is current-amplified via the first operational amplifier A1 is supplied to the second amplifying stage 16B. Alternatively, the first amplifying stage 16A can be implemented with a transistor amplifier.

In a similar manner, the second amplifying stage 16B performs a voltage amplification for the inverted gate start signal/GSP from the output terminal of the first operational amplifier A1. At the same time, the second amplifying stage 16B also inverts the inverted gate start signal/GSP. To this end, the second amplifying stage 16B includes a second operational amplifier A2 receiving the inverted gate start signal/GSP from the output terminal of the first operational amplifier A1 to its inverting terminal (−) through a first resistor R1, and a second resistor R2 connected between the inverting and output terminals of the second operational amplifier A2. The second operational amplifier A2 amplifies and inverts the voltage of the inverted gate start signal/GSP from the output terminal of the first operational amplifier A1 with the inverted gate start signal/GSP being amplified by the amplification factor of −R1/R2. As a result, a voltage-amplified gate start signal is generated at the output terminal of the second operational amplifier A2. The second amplifying stage 16B preferably has a variable resistor VR for applying a reference voltage to the non-inverting terminal (+) of the second operational amplifier A2. The variable resistor VR is connected between a power voltage line VDDL and a ground voltage line GNDL. Also, the variable resistor VR divides a power voltage Vdd from the power voltage line VDDL and applies the divided voltage to the non-inverting terminal of the second operational amplifier A2 as the reference voltage. The variable resistor VR is preferably controlled by a manufacturer or an operator so that the reference voltage has a voltage level that is substantially equal to the low voltage level of the gate signal GS.

The voltage-amplified gate start signal GSP is converted into the storage voltage signal SVS via the integrator 16C, which charges the voltage from the output terminal of the second operational amplifier A2 when the gate start signal GSP maintains a high logic state. When the gate start signal has a low logic state, the integrator 16C discharges the charged voltage toward the storage line SL. As a result, the storage voltage signal SVS to be applied to the storage line SL has a waveform as shown in FIG. 5. In order to generate the storage voltage signal SVS, the integrator 16C preferably includes the output terminal of a third resistor R3 connected between the second operational amplifier A2 and the storage line SL, and a capacitor C1 between the storage line SL and the ground voltage line GNDL. The trailing edge of the storage voltage signal SVS varies along with a time constant that is determined by multiplying the resistance of the third resistor R3 with the capacitance of the capacitor C1. The resistance of the third resistor R3 and the capacitance of the capacitor C1 are preferably set up to have values that allow the storage voltage signal SVS to have the voltage of −4.96V at the falling edge of the first gate signal GS.

As described above, since the storage voltage signal SVS has the voltage of −4.96V at the trailing edge of the first gate signal GS1, the signal voltage charged at each picture element on the first gate line GL1 is substantially equal to the signal voltage charged at each picture element on the remaining gate lines GL2 to GLn. As a result, the luminance level is displayed uniformly on the liquid crystal panel 10, and the quality of a picture displayed on the liquid crystal panel 10 is thereby greatly enhanced.

Figure 8:
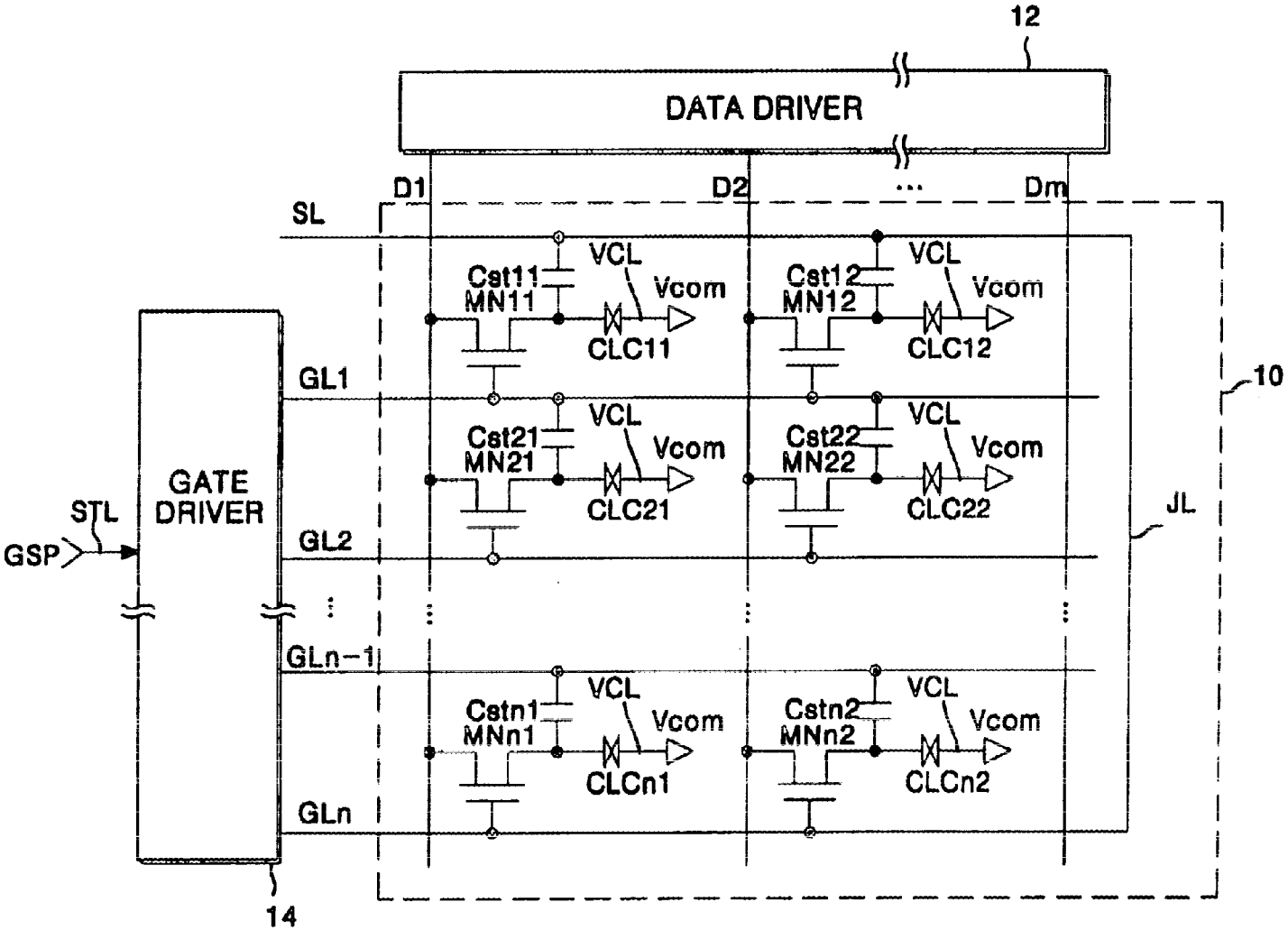
FIG. 8 is a schematic view showing a liquid crystal panel drive apparatus according to another preferred embodiment of the present invention.

FIG. 8 shows a liquid crystal panel drive apparatus according to another preferred embodiment of the present invention. The liquid crystal panel drive apparatus of FIG. 8 is preferably similar to that of FIG. 4. A junction line JL is preferably connected between the storage line SL and the nth gate line GLn on the liquid crystal panel 10. The junction line JL can be installed on a printed circuit board (not shown). In this case, the printed circuit board is connected to one end of the storage line SL and one end of the nth gate line GLn.

In FIG. 8, the junction line JL transmits the gate signal GSn on the nth gate line GLn toward the storage line SL. The storage line SL maintains the voltage of −4.96V at the trailing edge of the first gate signal GS1. Similarly, the first to (n−1)th gate lines GL1 to GLn−1 are respectively charged by the voltage of −4.96V at the trailing edges of the second to nth gate signals GS2 to GSn. In other words, the voltage on the storage line SL becomes −4.96V when the TFTs MN11 to MN1*m* are turned-off. As a result, the signal voltage charged at each picture element on the first gate line GL1 is substantially equal to the signal voltage charged at each picture element on the remaining gate lines GL2 to GLn and the luminance level is uniformly displayed on the liquid crystal panel 10 and the quality of a picture displayed on the liquid crystal panel 10 is further enhanced.

Figure 9:
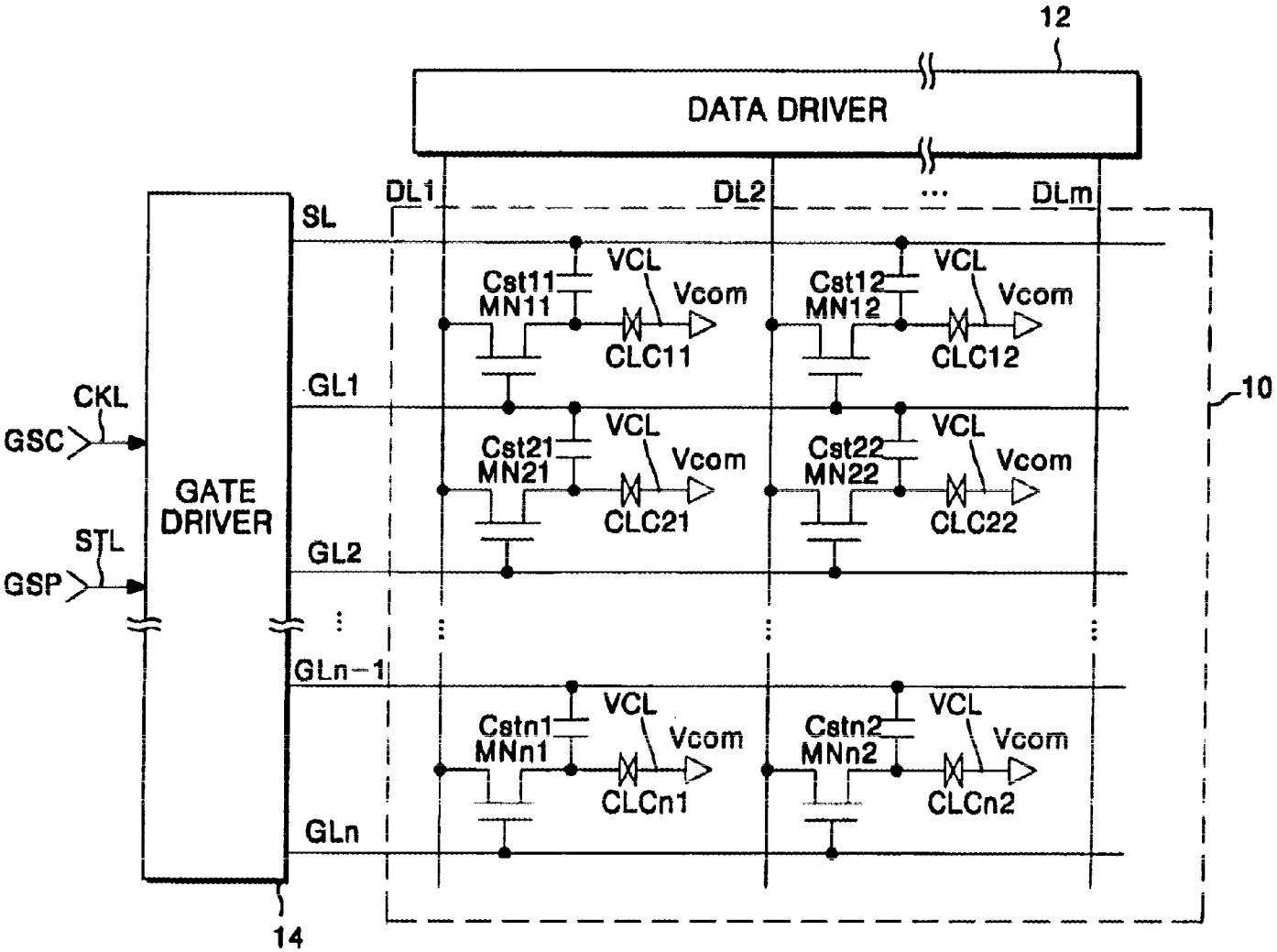
FIG. 9 is a schematic view showing a liquid crystal panel drive apparatus according to still another preferred embodiment of the present invention.

Referring to FIG. 9, there is illustrated a liquid crystal panel drive apparatus according to still another preferred embodiment of the present invention. The liquid crystal panel drive apparatus includes a liquid crystal panel 10 having picture elements arranged at intersections of gate lines GL1 to GLn and data lines DL1 to DLm. Each picture element preferably includes a TFT MN11 to MNnm having a gate terminal connected with the gate line GL and a source terminal connected with the data line DL, a liquid crystal cell CLC11 to CLCnm connected between the drain terminal of the TFT MN11 to MNnm and a common voltage line VCL, and an additional capacitor Cst11 to Cstnm connected to the drain terminal of the TFT MN11 to MNnm. The additional capacitors Cst21 to Cstnm arranged on the second to nth gate lines GL2 to GLn are also connected to the respective gate lines GL1 to GLn−1. Whereas, the additional capacitors Cst11 to Cst1*m* on the first gate line GL1 are connected to a storage line SL. The storage line SL is used as a storage capacitor of the picture elements connected to the first gate line GL1. Similarly, the first to (n−1)th gate lines GL1 to GLn−1 are used for the storage capacitor of the picture elements on the second to nth gate lines GL2 to GLn, respectively.

The liquid crystal panel drive apparatus also preferably includes a data driver 12 connected to the data lines DL1 to DLm on the liquid crystal panel 10. The data driver 12 applies video signals to the data lines DL1 to DLm on the liquid crystal panel 10 during every horizontal synchronous period. Alternatively, the data driver 12 can drive the data lines DL1 to DLm on the liquid crystal panel 10 using a dot inversion system. In the dot inversion system, the video signal on one data line DLi has a polarity that is opposite to that of the video signals on the data lines DLi−1 and DLi+1, both of which are adjacent to the data line DLi.

Figure 10:
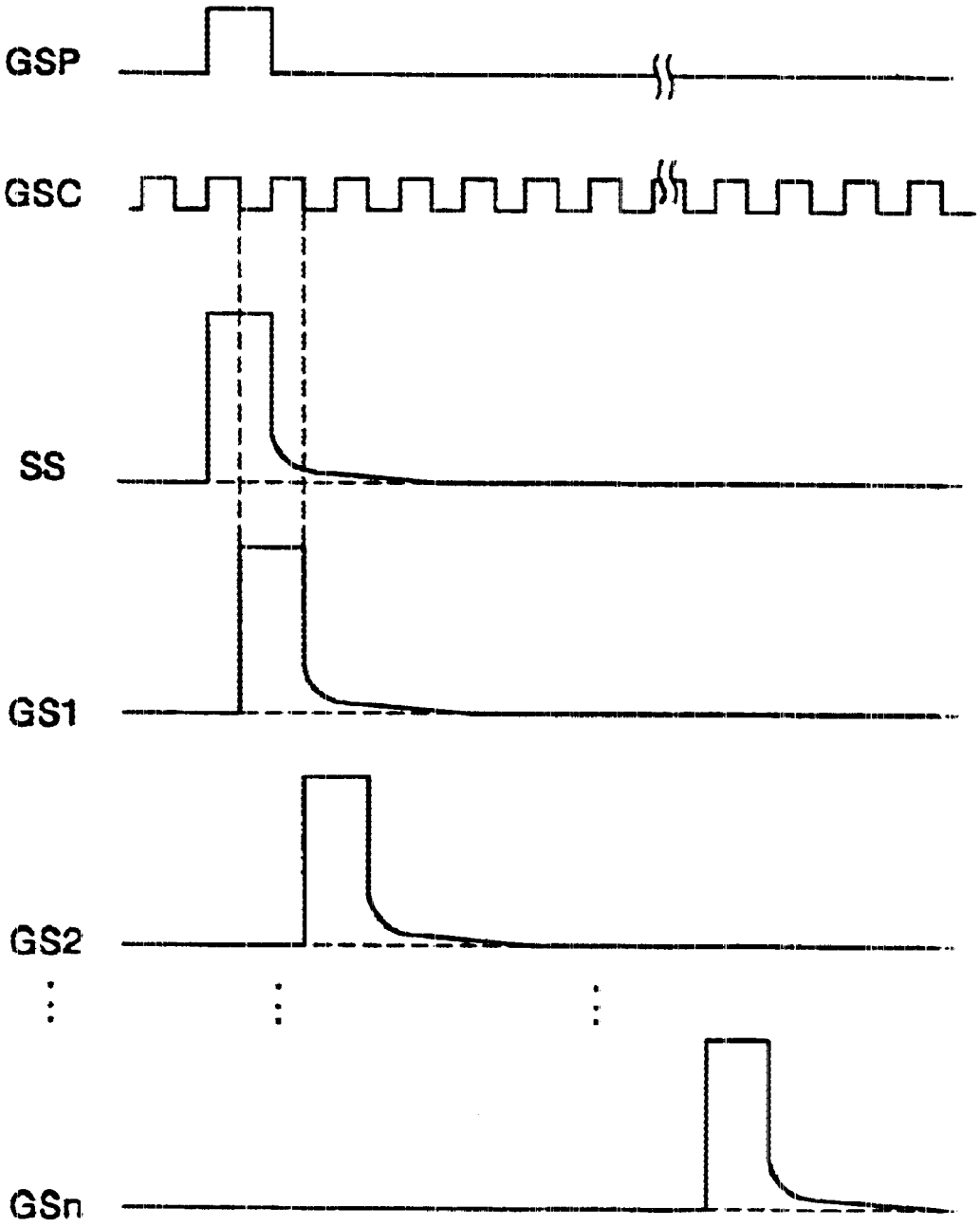
FIG. 10 is a waveform diagram showing signals applied to the storage line and gate lines in FIG. 9.

Furthermore, the liquid crystal panel drive apparatus preferably has a gate driver 14 for responding to a gate start signal GSP from a start signal line STL and a gate shift clock GSC from a clock line CKL. The gate driver 14 generates a storage signal SS and n gate signals GS1 to GSn at every gate line when the start signal GSP has a high logic pulse, as shown in FIG. 10. The storage signal SS has rising and trailing edges synchronized with the gate start signal GSP, and is at a phase that is earlier than the first gate signal GS1 by a half period of the gate shift clock GSC. Also, the waveform of the storage signal SS is substantially equal to that of each gate signal GS1 to GSn. The n gate signals GS1 to GSn have a high logic pulse occurring sequentially beginning from the falling edge of the gate start signal GSP. Signals GS1 to GSn are sequential in that they are separated by a half period of the gate shift clock GSC, as shown in FIG. 10. The trailing edge of each storage signal SS and the gate signal GS1 to GSn consumes about a few milliseconds. In particular, the trailing edge of each of the storage signals SS and the gate signals GS1 to GSn fall from the voltage level of 20V to the voltage level of −4.96V within microseconds and from the voltage level of −4.96V to the voltage level of −5V in a period of few milliseconds. Also, the gate driver 14 applies n gate signals GS1 to GSn to n gates lines GL1 to GLn and the storage signal SS to the storage line SL, respectively.

The TFTs MN are sequentially turned-on by the gate signals GS1 to GSn for one line. The video signals on the data lines DL1 to DLm are simultaneously applied to the liquid crystal cells CLC and the additional capacitors Cst through each TFT MN. Then, the liquid crystal cells CLC and the additional capacitors Cst charge the video signal applied from the data line DL through the TFT MN. Also, the liquid crystal cell CLC and the additional capacitor Cst maintain the charged signal voltage until the TFT MN is turned-on again, i.e., during turning-off of the TFT MN.

When TFTs MN11 to MN1*m* on the first gate line GL1 are turned-off, the storage voltage signal on the storage line SL maintains the voltage level of −4.96V. Also, each gate signal GS1 to GSn−1 on the first to (n−1)th gate lines GL1 to GLn−1 has the voltage level of −4.96V when the TFTs MN21 to MNnm on gate lines GL2 to GLn are turned-off. As a result, the picture elements on liquid crystal panel 10 charge the same signal voltage when the same video signal is applied to the picture elements on the liquid crystal panel. In particular, each of the picture elements on the first gate line GL1 charges a signal voltage VS1 that is higher than the low level voltage of the gate signal GS by Vd, as shown in FIG. 6A, at the trailing edge of the first gate signal GS1. Similarly, the picture elements on the second to nth gate lines charge a second signal voltage VS2 that is higher than the low voltage level of the gate signal GS by Vd, as shown in FIG. 6B, at the trailing edge of the respective gate signal GS2 to GSn. As a result, the luminance level on a first line of the liquid crystal panel is substantially equal to that on the remaining lines and the luminance level is uniformly displayed on the liquid crystal panel 10, which further enhances the quality of a picture displayed on the liquid crystal panel 10.

Although the present invention has been explained with reference to the preferred embodiments shown in the drawing hereinbefore, it should be understood by the ordinary skilled person in the art that the invention is not limited to the above-mentioned preferred embodiments, but that various changes or modifications thereof are possible without departing from the spirit of the invention. Accordingly, the scope of the invention shall be determined only by the appended claims and their equivalents.

What is claimed is:

1. A liquid crystal display apparatus comprising:

a liquid crystal panel;

a storage line on the liquid crystal panel;

a plurality of gate lines on the liquid crystal panel transmitting gate signals thereon;

a start signal line transmitting a gate start signal thereon; and a liquid crystal panel driver arranged to supply a signal to said storage line that has a substantially equal falling time as that of signals supplied to said plurality of gate lines, whereby a luminance level is uniformly displayed in the liquid crystal panel.

2. The apparatus according to claim 1, wherein the liquid crystal panel driver includes a gate driver and a storage line driver.

3. The apparatus according to claim 2, wherein the storage line driver includes an inverter, a first amplifying stage, a second amplifying stage and an integrator.

4. The apparatus according to claim 1, further comprising a plurality of picture elements disposed on each of the gate lines, wherein the current signal.supplied to the storage line is such that a signal voltage charged at each of the picture elements on a first one of the plurality of gate lines is substantially equal to a signal voltage charged at each of the picture elements on each of the remaining ones of the plurality of gate lines.

5. The apparatus according to claim 1, wherein said gate start signal has an amplitude smaller than the amplitude of said gate signals, the apparatus further comprising an amplifier for amplifying the amplitude of said gate start signal to equal to the amplitude of said gate signal and a converter for converting said gate start signal to the current signal supplied to the storage line.

6. A liquid crystal display apparatus comprising:

a liquid crystal panel;

a storage line on the liquid crystal panel;

a plurality of gate lines on the liquid crystal panel; and a connector arranged to connect said storage line with at least one of said plurality of gate lines, whereby a luminance level is uniformly displayed in the liquid crystal panel.

7. The apparatus according to claim 6, wherein the connector is disposed on the liquid crystal panel.

8. The apparatus according to claim 6, wherein said connector is disposed on a printed circuit board to connect one end of said storage line with at least one of said plurality of gate lines.

9. A liquid crystal display apparatus comprising:

a liquid crystal panel;

a storage line disposed on the liquid crystal panel;

a gate start line arranged to transmit a gate start signal;

a plurality of gate lines arranged to transmit gate signals; and a gate driver arranged to drive said plurality of gate lines, wherein said gate driver includes a storage drive terminal arranged to supply a signal for driving said storage line, whereby a luminance level is uniformly displayed in the liquid crystal panel.

10. The apparatus according to claim 9, wherein said storage drive terminal applies a storage drive signal to said storage line such that said storage drive signal has a phase that is synchronized with said gate start signal.

11. The apparatus according to claim 9, wherein said storage drive signal has a waveform that is substantially the same as a waveform of said gate signals.

12. The apparatus according to claim 9, wherein said storage drive terminal is arranged to supply a storage drive signal to said storage line, said storage drive signal having a phase that leads a phase of said gate signals by about one half of a period of said clock signal.

13. A method of driving a liquid crystal panel comprising the steps of:

supplying a gate start signal to a start signal line;

supplying a gate signal to a plurality of gate lines; and supplying an alternative current signal to a storage line, wherein the alternative current signal has a substantially equal falling time as that of the gate signal, whereby a luminance level is uniformly displayed in the liquid crystal panel.

14. The method according to claim 13, further comprising the steps of:

amplifying the amplitude of said gate start signal; and converting said gate start signal to said alternative current signal.

15. The method according to claim 13, further comprising the step of connecting said storage line with at least one of said gate lines.

16. A method for driving a liquid crystal panel comprising the steps of:

driving a start signal line with a gate start signal;

driving a plurality of gate lines on the liquid crystal panel; and applying a storage drive signal to a storage line on the liquid crystal panel, said storage drive signal being changed in synchronization with said gate start signal and having a desired signal delay, whereby a luminance level is uniformly displayed in the liquid crystal panel.

17. A method for driving a liquid crystal panel comprising the steps of:

driving a start signal line with a gate start signal;

driving a plurality of gate lines on the liquid crystal panel; and applying a storage drive signal to a storage line on the liquid crystal panel, said storage drive signal having a waveform that is substantially the same as a waveform of signals for driving the plurality of gate lines, whereby a luminance level is uniformly displayed in the liquid crystal panel.

* * * * *